United States Patent [19]

Robinson

[11] Patent Number: 4,660,987

[45] Date of Patent: Apr. 28, 1987

[54] BLENDER ROTOR IMPROVEMENTS

[75] Inventor: Jon L. Robinson, Belgrade, Minn.

[73] Assignee: TCI, Inc., Benson, Minn.

[21] Appl. No.: 828,705

[22] Filed: Feb. 12, 1986

[51] Int. Cl.[4] ..... B28C 5/14; B01F 7/04

[52] U.S. Cl. ..... 366/67; 366/285; 366/313; 366/325

[58] Field of Search ..... 366/64–67, 366/279, 309–313, 325, 327, 326, 329, 330, 285, 286

[56] References Cited

U.S. PATENT DOCUMENTS

| | | | |
|---|---|---|---|
| 1,861,721 | 6/1932 | Scott . | |
| 2,750,163 | 6/1956 | Loedige et al. | 259/109 |
| 3,292,911 | 12/1966 | Paul | 366/313 |
| 3,652,062 | 3/1972 | Baker | 259/9 |
| 3,734,469 | 5/1973 | Goldstein et al. | 259/8 |
| 3,877,881 | 4/1975 | Ono et al. | 23/285 |
| 4,202,636 | 5/1980 | Vanderveen | 366/319 |
| 4,225,247 | 9/1980 | Hodson | 366/40 |
| 4,274,751 | 1/1981 | Rector et al. | 366/310 |
| 4,478,515 | 10/1984 | Tobin | 366/67 |
| 4,515,483 | 5/1985 | Muller et al. | 366/303 |

FOREIGN PATENT DOCUMENTS

| | | | |
|---|---|---|---|
| 1045625 | 1/1979 | Canada | 366/312 |

*Primary Examiner*—Timothy F. Simone
*Attorney, Agent, or Firm*—Kinney & Lange

[57] ABSTRACT

A rotor for a particulate material blender which form an outer tub or housing having at least a part cylindrical wall, and which is used for blending or mixing materials that are particulate using a plurality of arms moving paddles at their outer ends with adjustable, flexible wiper blades which engage the part cylindrical wall. The blender can be used for uniformly distributing materials that have different particle sizes, or for mixing two or more different materials together. The unit is particularly suitable for blending inorganic fertilizer materials quickly and efficiently.

1 Claim, 5 Drawing Figures

BLENDER ROTOR IMPROVEMENTS

BACKGROUND OF THE INVENTION

1. Field of the Invention

The present invention relates to blenders for particulate material and specifically to improvements in paddles used with such blenders.

2. Description of the Prior Art

In the prior art, blenders have been well known for mixing various materials, including particulate material mixers that are for dry materials.

U.S. Pat. No. 4,274,751 shows a agitator or mixer to mix the contents of a vessel that has a vertical axis, and includes wiper blades at the outer ends or edges of a spiralling ribbon rotor. The spiral blades carry Teflon type outer scraper blades positioned adjacent the interior surface of the vessel. The blades are positioned at a helix angle with respect to the axis of rotation of the mixer rotor.

U.S. Pat. No. 4,478,515 shows a motar mixer with a "triple eight" mixing axis, utilizing a rotor having arms extending from a central shaft, and having blades at the outer ends thereof, including a type of adjustable resilient blade that will engage the side walls of the mixer housing to tend to scrape materials off the housing walls at the same time that the mixing action is occurring.

SUMMARY OF THE INVENTION

The present invention relates to a blender for material utilizing a horizontal axis rotor, and an outer housing or tub that has a part cylindrical bottom and upwardly extending side and end walls. The radial arms carry paddles that are positioned at a desired angle with respect to the axis of rotation of the central shaft. The paddles have adjustable wiper blades at the outer ends.

The adjustable wiper blades permit adjustment to compensate for wear and the like and to insure that there is essentially zero clearance between the outer ends of the paddles and blades and the lower-most section of the housing or tub wall so that a very thorough mixing and wiping action takes place.

The paddles and blades are adapted for rapid removal and adjustment of the wiper blades from the radially extending arms, which are fixed on the central shaft.

In order to aid in the blending action, and insure thorough mixing, the paddles and the adjustable wiper blades at the outer ends of the arms have curved outer edges that conform to the surface of the part cylindrical wall that the wiper blades engage as they are rotated. The wiper blades engage the inner surface of the tub for at least a portion of the arc of travel.

The planes of the wiper blades are positioned at substantially 45° with respect to the axis of rotation of the shaft, so that they cover a path that is elongated in longitudinal length. The wiper blades are resilient so they aid in insuring conformance to the side surfaces of the tub or housing to wipe the particulate material clean from the lower wall of the tub, and provide adequate and thorough mixing. The paddles will also tend to move material in axial directon as the rotor rotates, as well as moving material circumferentially.

DETAILED DESCRIPTION OF THE PREFERRED EMBODIMENT

A particulate material blender indicated generally at 10 as shown comprises an outer housing or tub 11 that has end walls 12 and 13, supported in a suitable manner from a support, such as a scale frame that will permit weighing materials. The tub can be stationarily supported in any desired location. While not shown, the container includes a discharge outlet at one side which can be opened so material that has been blended may be removed. A conveyor will usually be used for removing material that flows out of the opened outlet.

Figure 2:
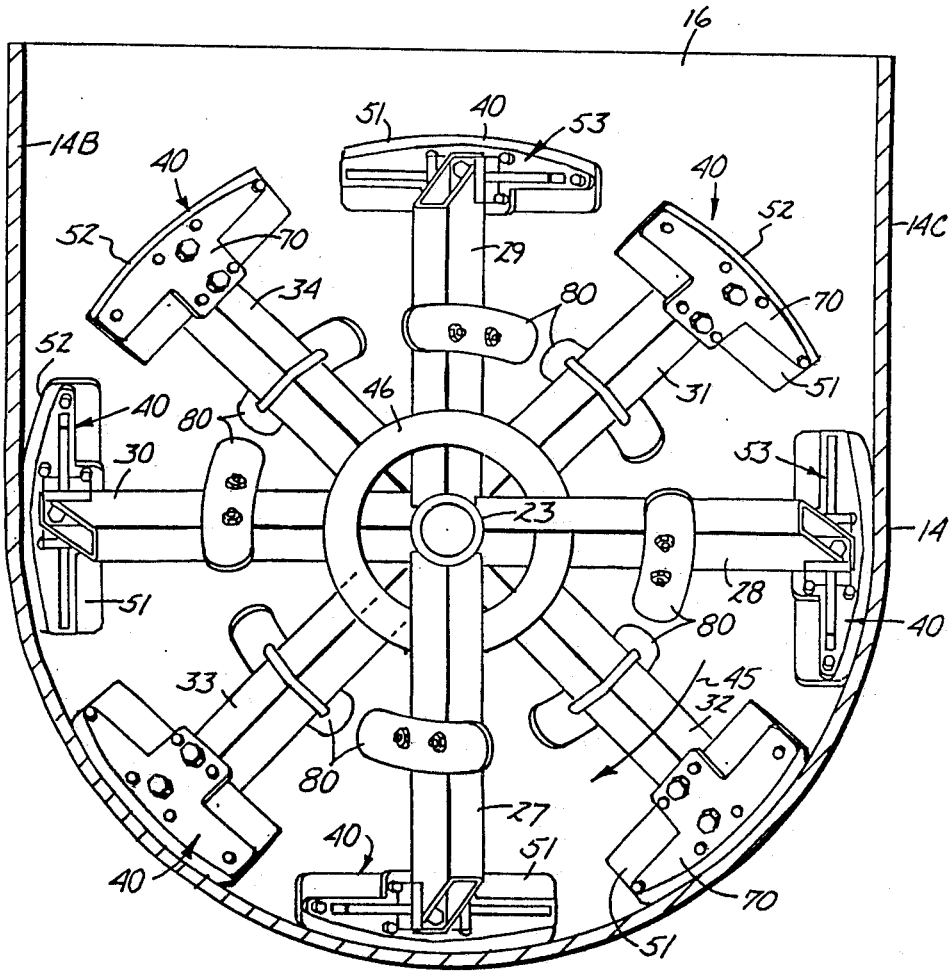
FIG. 2 is a sectional view taken as on line 2—2 in FIG. 1.

As can be seen in FIG. 2, the end walls 12 and 13 mate with a main housing or tub wall 14, which includes a lower part cylindrical section 14A, and uprightly extending side wall portions 14B and 14C. The wall 14, together with the end walls 12 and 13 forms an open top 16 through which material to be blended can be dumped onto the interior of the tub.

A blender rotor assembly indicated generally at 20 has a central rotor shaft member 21, that is suitably mounted in bearings 22 in turn mounted on the respective end walls 12 and 13. The shaft member 21 includes an outer end portion on which a drive sprocket 24 is drivably mounted. The drive sprocket 24 is driven with a chain 25, from a motor 26, which is shown only schematically. The motor 26 can be any desired type of motor, and, if necessary, suitable speed reducers can be used.

The rotor assembly 20 includes a plurality of radially extending arms indicated generally at 25. Each of the arms is identically constructed, but they are oriented at different angular positions, and include arms 27, 28, 29, 30, 31, 32, 33 and 34. As shown, there are eight such arms, but the number can be varied as desired.

Figure 1:
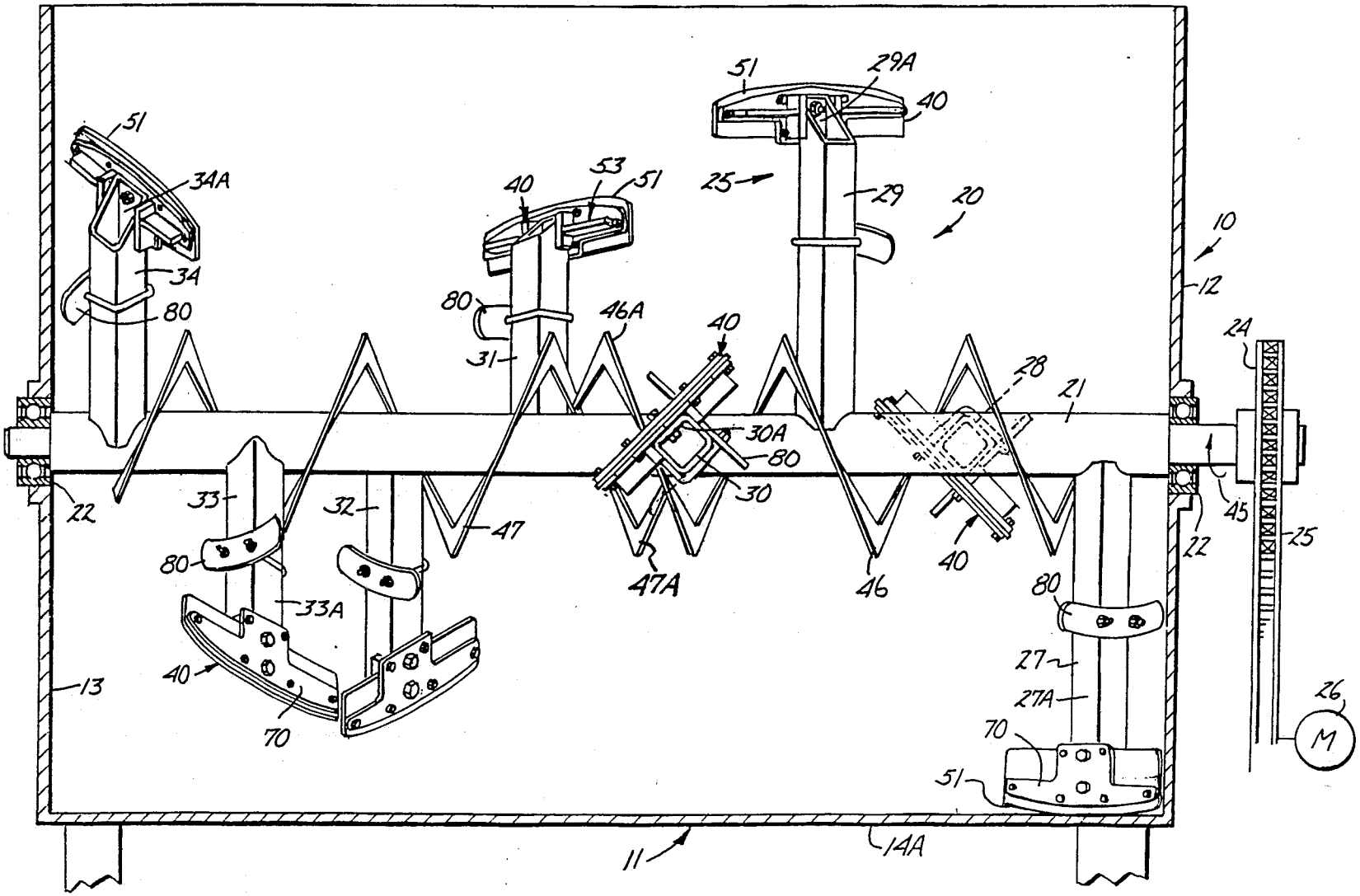
FIG. 1 is a vertical sectional view through a typical blender tub, showing the wall schematically, and illustrating a rotor mounted in the center thereof having paddles at the outer ends of radial arms and including wiper blades made according to the present invention.
Figure 3:
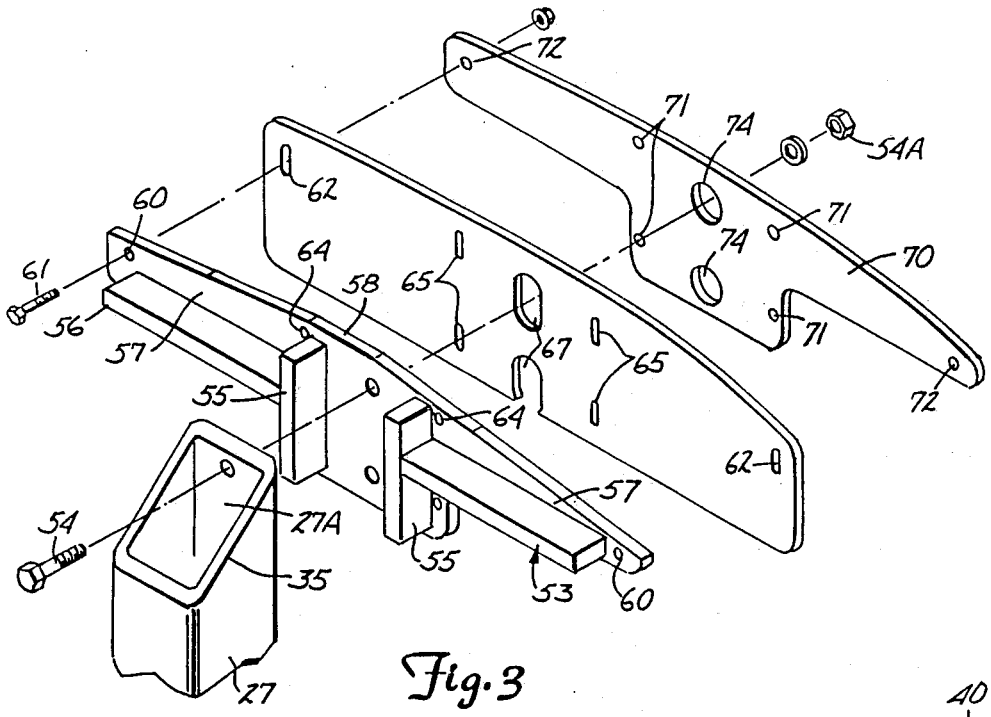
FIG. 3 is an exploded perspective view of a typical paddle and adjustable wiper blade construction.

Each of the arms is trimmed at the upper end at an angle, so that it tapers from an outer edge back toward the shaft 21, as indicated at 35 in FIGS. 1 and 2, and also as can be seen in FIG. 3. As shown the arms are square tubes. The tapered cut shown at 35 on each arm forms access to the interior of a mounting wall shown at 27A–34A of each arm. A paddle assembly indicated generally at 40 is mounted on each arm and is bolted to the mounting wall of the respective arm. The paddle assemblies will be more particularly described, but it can be seen that the plane of the reference walls 27A–34A of the arms and the planes of the paddles are oriented at 45° with respect to the longitudinal axis indicated at 21A of the shaft 21. This can be seen with arm 31 perhaps best, and it also can be seen that half of the arms have their reference surfaces facing toward the wall 13 (these are the arms that are most closely adjacent the wall 12) and the other four arms have the surfaces of the mounting walls 31A–34A facing toward the wall 12. With this orientation, and with the direction of rotation as indicated by the arrow 45 in both FIGS. 1 and 2, it can be seen that material that is within the tub or housing will be engaged by the paddles. The four paddles on each side of a plane bisecting the rotor and perpendicular to the rotor axis will tend to move the material axially along the shaft 21 toward the center of the tub and toward the center of the shaft 21.

Ribbons of spiral flighting or helical auger flighting indicated at 46 and 47, respectively surround the central shaft 21. As can be seen the spiral flighting is a narrow ribbon that is spaced from the periphery of the shaft 21 and is fixed to the radially extending arms to hold the spiral flighting in position. Note that in the center of the tub or housing, the spiral flighting portions indicated at 46A and 47A overlap. As the rotor is rotating the paddles will tend to move the material in an opposite direction from the spiral flighting. In other words, the spiral flighting strip 46 will tend to move the material adjacent the shaft toward the wall 12, and the spiral flighting strip 47 will tend to move the material adjacent the shaft 21 toward the wall 13, while the associated or aligned arms and outer paddle assemblies 40 will tend to move the material in opposite directions.

Figure 4:
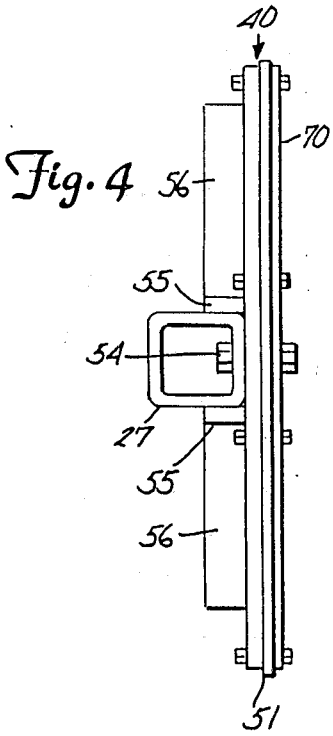
FIG. 4 is a top plan view of the assembly of FIG. 3.
Figure 5:
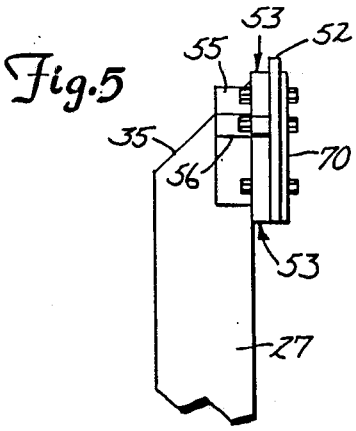
FIG. 5 is a side elevational view of the assembly of FIG. 4.

A typical paddle assembly shown in FIGS. 3, 4 and 5 provides for a means of quickly adjusting a flexible member from its radial position, so that it will engage the inner surface of the hopper wall 14, in the part cylindrical portions 14A, and can be adjusted so that as it wears it can be adjusted outwardly to compensate for such wear.

A typical arm 27 is shown in FIG. 3 and it has the tapered outer end 35, with a plurality of bolt holes 50 at the outer end of the mounting wall 27A. The paddle assembly 40 for arm 27 as shown is typical of those used, and is a multiple part member including a flexible wiper blade 51 that has a contoured or curved wearing edge 52 that provides for a close fit between the wiper blade edge and the inner surface of the wall 14, when the paddle is angled at 45° with respect to the axis of the rotor shaft. A backing member 53 is provided, and this attaches directly to the mounting wall 27A utilizing suitable bolts 54, passing through the openings 50 and through suitable aligning openings in the center portion of the backing member 53. Bolts 54 are used only for fastening the backing member in place, and do not fasten the associated wiper blade 51. The backing member 53 includes guide lugs 55,55 which define a space for arm 27 and fit along the side walls of the arm 27. The backing member 53 has reinforcing ribs 56 that extend out laterally from the guide members 55, and reinforce and support wing portions 57 of the backing plate 58 that forms part of the backing member 53. The outer edge of plate 58 tapers from the center toward the outer ends of the wings, so that the edge is recessed from the curved edge 52 of the wiper blade 51. The outer ends of the wing portions 57 have apertures or openings 60 therein, through which bolts 61 can pass and these openings align with slots 62 at the outer edges of the flexible wiper blade 51. Additionally, apertures such as those shown at 64 are provided in the backing member plate 58 to align with suitable slots 65 in the flexible wiper blade 51.

Large openings indicated at 67 are provided in the flexible wiper member to provide clearance for the nuts used on bolts 54, and permit the flexible member to be adjusted along the slots 62 and 65 radially outwardly with respect to the edge of the backing plate 58.

A clamp plate 70 is provided on the outside of the wiper blade to form a sandwich construction. The clamp plate 70 is clamped against the outer surface of the flexible wiper blade 51. It has openings or apertures shown at 71 which align with the openings 64, and also openings 72 that align with the openings 60 and slots 62. The bolts 54 clamp the backing plate 58 only, as stated, and thus the clamp plate 70 has large openings 74 which are sufficiently large to clear the nuts 54A shown in FIG. 3. The slots 67 in flexible wiper blade 51 are large enough to clear the nuts 54A.

FIGS. 4 and 5 show the paddle assembly 40 from the outer side or top and fron the side. It can be seen that the sandwich construction can be tightened down with suitable bolts passing through the openings 64, 65 and 71, and the openings 60, 62 and 72. By clamping the clamp plate 70 tightly against the flexible wiper blade 51, the wiper blade is in turn clamped tightly against the backing plate. A small edge portion of the edge 52 of wiper blade 51 protrudes above the edge of the clamp plate 70 and the edge of the backing plate 58 for the wiping action. The clamp plate 70 extends farther and will hold it securely in its desired position so that the edge 52 protrudes a sufficient amount. The slots 62 and 65 permit the flexible wiper blade 51 to be pushed radially outwardly a desired amount for adjustment. The adjustment can compensate for tolerances in manufacturing the rotor assembly and the tub or housing, and also to permit for adjustment when the wiper blades tend to wear.

The wiper blades 51 are made of a suitable resilient material such as belting type material that is heavy and relatively rigid, but yet will conform to slight irregularities and will bend when it is overloaded.

The wiper assemblies 40 thus are easily mounted onto the ends of the radial rotor arms and by providing the adjustable feature for the wiper blades, a very thorough job of blending and material treatment is achieved. Likewise, the use of the adjustable wiper blades to thoroughly wipe the interior surfaces work well. There is efficient blending such as with the radial arms, and the spiral ribbons that provide for moving the material adjacent the shaft from the center of the shaft outwardly toward its ends, while the blades tend to move the material at the outer portions of the tub or housing from the end walls toward the center. Additional mixing can be obtained by adding intermediate blades 80 which are clamped to the arms against walls 90° from the arm walls 27A–34A.

The flexible wiper blade 51 can be adjusted sufficiently to provide for substantial use before replacement, and yet provide a good seal against the inner surface of the tub or housing.

Although the present invention has been described with reference to preferred embodiments, workers skilled in the art will recognize that changes may be made in form and detail without departing from the spirit and scope of the invention.

What is claimed is:

1. In combination with a particulate material blender having an outer housing defined by a part cylindrical wall, and a rotor having a center shaft and a plurality of arms extending outwardly from the center shaft, each of said arms having an outer end, each of said arms also being of rectilinear cross section to provide a first wall that is generally planar, the improvement comprising a paddle assembly mounted at the outer end of each arm, each paddle assembly comprising a backing plate, means to removably attach the backing plate to a respective arm against its first wall, first bolt means to removably fasten the backing plate to the first wall in proximity to a portion of the part cylindrical wall as the center shaft is rotated, said backing plate being clamped against the first wall of its respective rectilinear cross section arm, and having guide members which are spaced apart to receive the arm and fit against walls of the arm that extend 90° to the first wall of the arm, said backing plate having radially extending wing portions extending outwardly from opposite sides of the arm on which it is attached to provide a substantial paddle width, a flexible wiper blade of size to extend beyond the periphery of the backing plate supported against said backing plate, and a clamp plate of substantially the same size as the backing plate fitting against a surface of the flexible wiper blade to clamp said flexible wiper blade against said backing plate, an outer edge of said flexible wiper blade being positioned outwardly of the backing plate and clamp plate and fitting closely adjacent the part cylindrical wall, said flexible wiper blade having a plurality of slots extending in radial direction with respect to the center shaft, and a plurality of sets of aligning bolt holes provided on each of the backing plates and clamp plates, the aligning bolt holes of each set on the plates aligning with a slot in the flexible wiper blade, and clamp bolt means passing through aligning bolt holes on the plates and a slot in the flexible wiper blade at a plurality of locations spaced across the flexible wiper blade surface to clamp the flexible wiper blade surface tightly against the backing plate, said clamp bolt means being separate from the means to attach the backing plate to its respective arm, said clamp bolt means being loosenable to permit the flexible wiper blade to be adjusted in radial direction and reclamped in position.

* * * * *